US010961611B2

(12) United States Patent
Liu et al.

(10) Patent No.: US 10,961,611 B2
(45) Date of Patent: Mar. 30, 2021

(54) HIGH-STRENGTH STEEL WITH YIELD STRENGTH OF 800 MPA AND PRODUCTION METHOD THEREFOR

(71) Applicant: BAOSHAN IRON & STEEL CO., LTD., Shanghai (CN)

(72) Inventors: Gang Liu, Shanghai (CN); Ana Yang, Shanghai (CN); Zigang Li, Shanghai (CN); Fengming Song, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 247 days.

(21) Appl. No.: 15/536,200

(22) PCT Filed: Dec. 8, 2015

(86) PCT No.: PCT/CN2015/096638
§ 371 (c)(1),
(2) Date: Jun. 15, 2017

(87) PCT Pub. No.: WO2016/095720
PCT Pub. Date: Jun. 23, 2016

(65) Prior Publication Data

US 2017/0349987 A1 Dec. 7, 2017

(30) Foreign Application Priority Data

Dec. 19, 2014 (CN) ..... 201410810303.X

(51) Int. Cl.
*C22C 38/54* (2006.01)
*C22C 38/48* (2006.01)
(Continued)

(52) U.S. Cl.
CPC ..... *C22C 38/54* (2013.01); *C21D 1/02* (2013.01); *C21D 1/18* (2013.01); *C21D 1/22* (2013.01);
(Continued)

(58) Field of Classification Search
CPC .. C21D 1/22; C21D 2211/008; C21D 8/0226; C21D 8/0263; C21D 9/46; C22C 38/001;
(Continued)

(56) References Cited

U.S. PATENT DOCUMENTS 6,248,191 B1 * 6/2001 Luton ..... C21D 1/19 148/653
6,852,175 B2 * 2/2005 Petersen ..... B60K 15/013 148/320
(Continued)

FOREIGN PATENT DOCUMENTS

CN 102363858 2/2012
CN 102605282 A 7/2012
(Continued)

OTHER PUBLICATIONS

PCT/CN2015/096638 International Search Report and Written Opinion, dated Mar. 18, 2016.

*Primary Examiner* — Jenny R Wu
(74) *Attorney, Agent, or Firm* — Thomas Horstemeyer, LLP

(57) ABSTRACT

A high-strength steel having a yield strength at a level of 800 MPa and a method of manufacturing the same, with the components and amounts thereof by weight percentage being: C: 0.06-0.14%, Si: 0.1-0.30%, Mn: 0.8-1.60%, Cr: 0.2-0.70%, Mo: 0.1-0.40%, Ni: 0-0.30%, Nb: 0.01-0.030%, Ti: 0.01-0.030%, V: 0.01-0.05%, B: 0.0005-0.0030%, Al: 0.02-0.06%, Ca: 0.001-0.004%, N: 0.002-0.005%, P≤0.02%, S≤0.01%, O≤0.008%, the balance of Fe and unavoidable impurities; wherein the above elements meet the following relationships: 0.40%<Ceq<0.50%, Ceq=C+Mn/6+(Cr+Mo+V)/5+(Ni+Cu)/15; 0.7%≤Mo+0.8Ni+0.4Cr+6V≤1.1%; 3.7≤Ti/N≤7.0; 1.0≤Ca/S≤3.0.

2 Claims, 2 Drawing Sheets

(51) Int. Cl.

| | |
|---|---|
| ***C22C 38/46*** | (2006.01) |
| ***C22C 38/04*** | (2006.01) |
| ***C22C 38/06*** | (2006.01) |
| ***C21D 8/02*** | (2006.01) |
| ***C22C 38/02*** | (2006.01) |
| ***C22C 38/00*** | (2006.01) |
| ***C22C 38/50*** | (2006.01) |
| ***C22C 38/44*** | (2006.01) |
| ***C22C 38/58*** | (2006.01) |
| ***C21D 1/22*** | (2006.01) |
| ***C21D 6/00*** | (2006.01) |
| ***C22C 38/32*** | (2006.01) |
| ***C21D 1/02*** | (2006.01) |
| ***C21D 1/18*** | (2006.01) |
| ***C21D 7/13*** | (2006.01) |
| ***C22C 38/40*** | (2006.01) |
| ***C22C 38/38*** | (2006.01) |
| ***C22C 38/28*** | (2006.01) |
| ***C22C 38/26*** | (2006.01) |
| ***C22C 38/22*** | (2006.01) |
| ***C22C 38/24*** | (2006.01) |
| *C21D 9/46* | (2006.01) |

(52) U.S. Cl.

CPC ..... *C21D 6/001* (2013.01); *C21D 6/002* (2013.01); *C21D 6/004* (2013.01); *C21D 6/005* (2013.01); *C21D 6/008* (2013.01); *C21D 7/13* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/40* (2013.01); *C22C 38/44* (2013.01); *C22C 38/46* (2013.01); *C22C 38/48* (2013.01); *C22C 38/50* (2013.01); *C22C 38/58* (2013.01); *C21D 9/46* (2013.01); *C21D 2211/008* (2013.01)

(58) Field of Classification Search

CPC ..... C22C 38/002; C22C 38/02; C22C 38/04; C22C 38/06; C22C 38/44; C22C 38/46; C22C 38/48; C22C 38/50; C22C 38/54; C22C 38/58

See application file for complete search history.

(56) References Cited

U.S. PATENT DOCUMENTS

| | | | | |
|---|---|---|---|---|
| 2009/0199612 | A1* | 8/2009 | Takahashi | B21C 37/08 72/369 |
| 2015/0329950 | A1* | 11/2015 | Azuma | C22C 38/38 148/533 |

FOREIGN PATENT DOCUMENTS

| | | | | |
|---|---|---|---|---|
| CN | 102719757 | | 10/2012 | |
| CN | 103014538 | A | 4/2013 | |
| CN | 103014545 | A * | 4/2013 | |
| CN | 103014545 | A | 4/2013 | |
| CN | 104513937 | A | 4/2015 | |
| EP | 1712651 | A1 * | 10/2006 | C21D 1/18 |
| EP | 2395120 | A | 12/2011 | |

* cited by examiner

HIGH-STRENGTH STEEL WITH YIELD STRENGTH OF 800 MPA AND PRODUCTION METHOD THEREFOR

CROSS-REFERENCE TO RELATED APPLICATIONS

This application is a 371 U.S. National Phase of PCT International Application No. PCT/CN2015/096638, filed on Dec. 8, 2015, which claims benefit and priority to Chinese patent application No. 201410810303.X, filed on Dec. 19, 2014. Both of the above-referenced applications are incorporated by reference herein in their entirety.

TECHNICAL FIELD

The disclosure relates to a high-strength steel with a yield strength at a level of 800 MPa and a production method thereof.

BACKGROUND ART

The use of a high-strength, easy-to-weld structural steel for manufacture of members of mobile equipments such as beam structures in engineering machinery, crane jibs, dumper bodies and the like can reduce the dead weights of the equipments, reduce fuel consumption, and increase operating efficiency. As the international competition intensifies, it has already become a trend to use a high-strength, easy-to-weld structural steel to manufacture members of mobile equipments such as beam structures in harbor machinery, mining machinery, excavating machinery and loading machinery, crane jibs, dumper bodies and the like. Due to the requirements of high performance, upsizing and light weight in the development of engineering machinery, the strength of the steel for engineering machinery is increased continuously from 500-600 MPa to 700 MPa, 800 MPa, and even 1000 MPa or higher in a short period of time. The harsh use environment and load conditions of the ultrahigh-strength steel for engineering machinery impose rigid requirements on the quality of the steel material, including strength, impact resistance, bending property, weldability, strip shape, etc.

At present, there are very few domestic enterprises capable of producing high-strength steel plates with a yield strength at a level of 800 MPa. Chinese Patent Application No. 201210209649.5 discloses a method for producing a high-strength steel plate with a tensile strength at a level of 800 MPa, wherein no Ni element is added, and a process of on-line quenching+tempering (DQ+T) is utilized to obtain a structure of tempered martensite+tempered lower bainite, wherein the yield strength is only 700 MPa. Chinese Patent Application No. 2011100343384.3 discloses a high-strength steel with a strength at a level of 750-880 MPa for vehicles and a production method thereof, wherein a TMCP process is utilized to produce a hot-rolled high-strength steel coil which is coiled at 560-600° C.

Currently, for a high-strength steel with a strength at a level of 800 MPa produced with a structure of tempered martensite+tempered lower bainite, the ratio of the structures varies greatly with the thickness, wherein greater thickness corresponds to lower strength, and the properties tend to be unqualified. For the precipitation strengthened high-strength steel produced with coiling at a high temperature of 560-600° C., the strength of the strip steel varies greatly at the head, middle and tail due to the influence of the size and number of the precipitate particles, and the requirement of the impact resistance at −40° C. cannot be satisfied.

SUMMARY

An object of the disclosure is to provide a high-strength steel having a yield strength at a level of 800 MPa and a method of producing the same, wherein an on-line quenching+tempering process is utilized, and the high-strength steel has a yield strength of 800-950 MPa, a tensile strength of 850-1000 MPa, an elongation >12%, and an impact energy at −40° C.>40 J.

To achieve the above object, the technical solution of the disclosure is as follows: A high-strength steel having a yield strength at a level of 800 MPa, with its components and amounts thereof by weight percentage: C: 0.06-0.14%, Si: 0.10-0.30%, Mn: 0.80-1.60%, Cr: 0.20-0.70%, Mo: 0.10-0.40%, Ni: 0-0.30%, Nb: 0.010-0.030%, Ti: 0.010-0.030%, V: 0.010-0.050%, B: 0.0005-0.0030%, Al: 0.02-0.06%, Ca: 0.001-0.004%, N: 0.002-0.005%, P≤0.020%, S≤0.010%, O≤0.008%, the balance of Fe and unavoidable impurities, wherein the above elements meet the following relationships: 0.40%<Ceq<0.50%, Ceq=C+Mn/6+(Cr+Mo+V)/5+(Ni+Cu)/15, 0.7%≤Mo+0.8Ni+0.4Cr+6V≤1.1%, 3.7≤Ti/N≤7.0, 1.0≤Ca/S≤3.0.

Further, the high-strength steel has a yield strength of 800-950 MPa, a tensile strength of 850-1000 MPa, an elongation >12%, and an impact energy at −40° C.>40 J.

The microstructure of the high-strength steel is tempered martensite.

In the compositional design of the steel according to the disclosure:

C: Carbon has the effect of solid solution strengthening. It regulates the strength and plastic toughness of the martensitic structure. The on-line quenched tensile strength of low-carbon martensite and the carbon content have the following relationship: Rm=2940C (%)+820 (MPa), wherein Rm is tensile strength. When the carbon content is 0.06% or higher, a tensile strength of greater than 900 MPa at a quenching state can be guaranteed. Then, the tensile strength is further regulated by tempering, reduced to 850 MPa or greater, so as to improve the toughness. An unduly high amount of carbon will result in increase of the carbon equivalent on the whole, leading to easy cracking during welding. Hence, the carbon content according to the disclosure is in the range of 0.06-0.14%.

Si: Si in an amount of 0.10% or higher has a good effect of deoxygenation, but red scale tends to occur when the Si content exceeds 0.30%. If the Si content is excessively high, the toughness of the martensitic high-strength steel tends to be degraded. Hence, the silicon content according to the disclosure is in the range of 0.10-0.30%.

Mn: Mn in an amount of 0.8% or higher can increase the hardenability of the steel. When the Mn content exceeds 1.6%, segregation and inclusions such as MnS tend to occur, degrading the toughness of the martensitic high-strength steel. Hence, the Mn content according to the disclosure is in the range of 0.80-1.60%.

Cr: Cr in an amount of 0.2% or higher can increase the hardenability of the steel, facilitating formation of a full martensitic structure during quenching. At a tempering temperature in the range of 400-550° C., Cr may form carbides of Cr, and has the effect of resisting softening during medium-temperature tempering. If the Cr content exceeds 0.70%, large sparks will occur during welding, affecting the welding quality. Hence, the Cr content according to the disclosure is in the range of 0.20-0.70%.

Mo: Mo element in an amount of 0.10% or higher can increase the hardenability of the steel, facilitating formation of a full martensitic structure during quenching. At a high temperature of 400° C. or higher, Mo can react with C to form compound particles having the effect of resisting softening during high-temperature tempering and softening of welded joints. An excessively high Mo content will lead to increase of the carbon equivalent, degrading weldability. Meanwhile, as Mo is a precious metal, the cost will be increased. Hence, the Mo content according to the disclosure is 0.10-0.40%.

Ni: Ni element has the effect of refining the martensitic structure and improving the steel toughness. An excessively high content of Ni will lead to increase of the carbon equivalent, degrading weldability. Meanwhile, as Ni is a precious metal, the cost will be increased. Hence, the Ni content according to the disclosure is 0-0.30%.

Nb, Ti and V: Nb, Ti and V are microalloy elements which form nano-scale precipitates with C, N and other elements, inhibiting growth of austenite grains during heating. Nb can increase the non-recrystallization critical temperature Tnr and expand the production window. The fine precipitate particles of Ti can improve weldability. V reacts with N and C during tempering to precipitate nano-scale V(C,N) particles, leading to improved steel strength. According to the disclosure, the Nb content is in the range of 0.01-0.03%, the Ti content is in the range of 0.01-0.03%, and the V content is in the range of 0.01-0.05%.

B: A trace amount of B can improve the hardenability and strength of the steel. When B exceeds 0.0030%, segregation tends to occur, and borocarbide compounds form, leading to serious degradation of the toughness. Hence, the B content according to the disclosure is in the range of 0.0005-0.0030%.

Al: Al is used as a deoxidizer. Addition of 0.02% or more Al to the steel can refine grains and improve the impact toughness. If the Al content exceeds 0.06%, inclusion flaws of Al oxides tend to occur. Hence, the Al content according to the disclosure is in the range of 0.02-0.06%.

Ca: In the smelting of steel, a trace amount of Ca element exceeding 0.001% can act as a purifier to improve the toughness of the steel. If the Ca content exceeds 0.004%, large-size Ca compounds tend to form, which degrades the toughness in turn. Hence, the Ca content according to the disclosure is 0.001-0.004%.

N: The content range of N element needs to be controlled strictly according to the disclosure. In a tempering process, N element having a content of 0.002% or higher can react with V and C to form nano-scale V(C,N) particles, and thus have the effect of precipitation strengthening. In a welding process, the softening of the heat-affected zone can also be inhibited by the precipitation strengthening. If the N content exceeds 0.005%, coarse precipitate particles tend to form, leading to degraded toughness. Hence, the N content according to the disclosure is 0.002-0.005%.

P, S and O: As impurity elements, P, S and O affect the plasticity and toughness of the steel. According to the disclosure, these four elements are controlled in the ranges of P≤0.02%, S≤0.01%, O≤0.008%.

The carbon equivalent Ceq of an on-line quenching type of high-strength steel having a yield strength at a level of 800 MPa needs to meet: 0.40%<Ceq<0.50%, Ceq=C+Mn/6+(Cr+Mo+V)/5+(Ni+Cu)/150. If Ceq is too low, softening of welded joints tends to occur; if Ceq is too high, microcracking tends to occur during welding.

According to the disclosure, the control of 0.7%≤Mo+0.8Ni+0.4Cr+6V≤1.1% is mainly used to guarantee equal-strength matching welding of the 800 MPa high-strength steel, and adjust the strength and low-temperature toughness of the welding heat affected zone to realize the optimal matching with the parent steel plate in terms of strength and low-temperature toughness. Mo, Ni and Cr elements all can decrease the critical cooling speed of the steel, increase the hardenability of the steel, and increase the strength of the welded joints. Mo reacts with C to form compounds at high temperatures, and it has the effect of resisting softening of the welded joints. Mo and Ni elements both have the effect of refining structures and improving toughness. V and N react to form nano-scale V(C, N) particles which can resist softening of the joints. The collaboration of Mo, Ni, Cr and V elements can regulate the strength and toughness of the welding heat affected zone based on the strength of the parent material. The total amount of Mo, Ni, Cr and V according to the disclosure is required to meet 0.7%≤Mo+0.8Ni+0.4Cr+6V≤1.1%. If lower than 0.7%, both the strength and low-temperature toughness of the welded joints will be low; if higher than 1.1%, the strength of the welded joints is rather high, and thus weld cracking tends to occur.

The control of 3.7≤Ti/N≤7.0 according to the disclosure can protect B atoms in the steel, so that B can be sufficiently solid-dissolved to increase the hardenability.

The control of 1.0≤Ca/S≤3.0 according to the disclosure can spheroidize sulfides in the steel, so as to improve the low-temperature toughness and weldability of the steel.

A method of producing a high-strength steel with a yield strength at a level of 800 MPa according to the disclosure comprises the following steps:

1) Smelting and Casting

A composition as described above is smelted in a converter or electrical furnace, subjected to refining, and cast to a cast blank;

2) Heating Cast Blank

The cast blank is heated at 1150-1270° C. in a furnace, wherein, when the core of the cast blank arrives at the temperature, the temperature is held, and the holding time is >1.5 h;

3) Rolling

The cast blank is rolled to a target thickness by single-stand reciprocating rolling or multi-stand hot continuous rolling, wherein the final rolling temperature is 820-920° C., and the final rolling temperature Tf meets: $Ar_3$<Tf<Tnr, wherein $Ar_3$ is the temperature at which hypo-eutectoid steel austenite begins to transform into ferrite: $Ar_3$=901−325C−92Mn−126Cr−67Ni−149Mo; Tnr is non-recrystallization critical temperature: Tnr=887+464C+(6445Nb−644 sqrt(Nb))+(732V−230 sqrt(V))+890Ti+363Al−357Si; the rolling reduction rate at the final rolling path is >15%;

4) Quenching Heat Treatment Process

After rolling, on-line quenching is conducted to (Ms−150) ° C. or lower by using a laminar cooling system to control the cooling speed $V>e^{(5.3-2.53c-0.16Si-0.82Mn-0.95Cr-1.87Mo-160B)}$° C./s, so as to guarantee formation of full martensitic structure, wherein Ms is the temperature at which transformation of martensite begins, Ms=539−423C−30.4Mn−17.7Ni−12.1Cr−11.0Si−7.0Mo.

5) Tempering Heat Treatment Process

Tempering heat treatment: The tempering temperature is 400-550° C.; when the temperature of the core of the steel plate arrives at the furnace temperature, the temperature is held, and the holding time is 20-180 min.

According to the production method of the disclosure:

In step (2), the cast blank is heated to 1150-1270° C., and the holding time of the core is >1.5 h. The heating temperature greater than 1150° C. and the holding time of the core >1.5 h can ensure full solid dissolution of the alloy elements. If the heating temperature exceeds 1270° C., the austenite grains will grow excessively, and thus the inter-grain binding force will be weakened, such that cracking tends to occur during rolling. In addition, if the heating temperature exceeds 1270° C., decarburization tends to occur on the surface of the steel blank, affecting the mechanical properties of the final product.

In step (3), in order to ensure rolling in the austenite zone, the final rolling temperature is greater than $Ar_3$; in order to ensure rolling in the non-recrystallization zone of austenite, the final rolling temperature is less than Tnr. Rolling in the non-recrystallization zone of austenite can refine austenite grains and the cooled structure, so as to improve the strength and toughness of the steel.

In step (3), the rolling reduction rate at the final rolling path is >15%. Rolling at a large reduction rate is utilized to form sufficient deformation energy in the non-recrystallization zone, induce recrystallization of austenite in the range of $Ar_3$-Tnr, and refine grains.

In step (5) of tempering heat treatment: when the tempering temperature of the steel of this compositional system exceeds 400° C. and the core of the steel plate is held at the tempering temperature for 20 min or longer, the oversaturated carbon atoms in the quenched martensite precipitate to form spherical $Fe_3C$ cementite, and alloys Mo and V may react with C at this temperature to form fine alloy carbides, which can improve the plasticity and toughness of the steel, and eliminate effectively the internal stress in the steel. If the tempering temperature exceeds 550° C. or the holding time is too long, the spherical $Fe_3C$ cementite and the alloy carbides will be coarsened, which will degrade the toughness of the steel and reduce the strength of the steel. The optical matching between the strength and the toughness can be realized by regulating the tempering temperature and the tempering time.

The disclosure involves the following relations:

0.40%<Ceq<0.50%; Ceq=C+Mn/6+(Cr+Mo+V)/5+(Ni+Cu)/15; 0.7%≤Mo+0.8Ni+0.4Cr+6V≤1.1%; 3.7≤Ti/N≤7.0; 1.0≤Ca/S≤3.0, wherein the element symbols represent the weight percentages of the corresponding elements.

The disclosure involves the following calculation formulae:

$$Ar_3=901-325C-92Mn-126Cr-67Ni-149Mo;$$

$$Tnr=887+464C+(6445Nb-644\ sqrt(Nb))+(732V-230\ sqrt(V))+890Ti+363Al-357Si;$$

$$Ms=539-423C-30.4Mn-17.7Ni-12.1Cr-11.0Si-7.0Mo;$$

$$e^{(5.3-2.53C-0.16Si-0.82Mn-0.95Cr-1.87Mo-160B)};$$

wherein each of the element symbols in the above formulae represents the weight percentage of the corresponding element ×100.

The beneficial effects of the disclosure include:

By using a process of controlling rolling, controlling cooling, and on-line quenching+tempering, the disclosure makes control with respect to the chemical compositional design, the structure of the parent material, the quenching heating temperature, the tempering heating temperature and the like, so as to obtain good elongation, low-temperature toughness and other properties while guaranteeing ultrahigh strength.

As compared with the prior art processes, the high-strength steel of Grade 800 MPa produced using the composition and process of the disclosure possesses uniform tempered martensitic structure; the properties vary little for different thicknesses, or for the head, middle and tail of a steel coil (steel plate); and the low-temperature impact toughness also increases greatly.

DETAILED DESCRIPTION

The disclosure will be further illustrated with reference to the following specific Examples.

A 50 kg vacuum electric furnace was used for smelting. The compositions of the steel according to the disclosure are shown in Table 1. Liquid steel smelted in the 50 kg vacuum electric furnace was cast into steel blanks having a thickness of 120 mm. The steel blanks were placed into an electric furnace for heating. The steel blanks were rolled to a target thickness of 10 mm in multiple paths. The final rolling temperature was 820-920° C. At the same time, the final rolling temperature Tf met: $Ar_3$<Tf<Tnr. The reduction rate at the final path was set to 17%. On-line quenching was conducted after rolling, wherein the quenching cooling speed was $V>e^{(5.3-2.53C-0.16S-0.82Mn-0.95Cr-1.87Mo-160B)}$ C./s. The final cooling temperature was (Ms~150°) C. or less. In the tempering heat treatment process, the tempering temperature was 400-550° C., and the tempering time was 20-180 min after the core of the steel plate arrived at the tempering temperature. The specific process conditions are shown in Table 2.

The on-line quenched+tempered steel plate was subjected to longitudinal tensile testing and longitudinal impact testing. The properties of various sample plates are shown in Table 3. As can be seen from Table 3, a quenched and tempered high-strength steel having a yield strength of 8000 MPa or higher can be manufactured according to the disclosure, wherein the tensile strength is 850-1000 MPa, the elongation is >12%, and the impact energy at −40° C. is >40 J.

Figure 1:
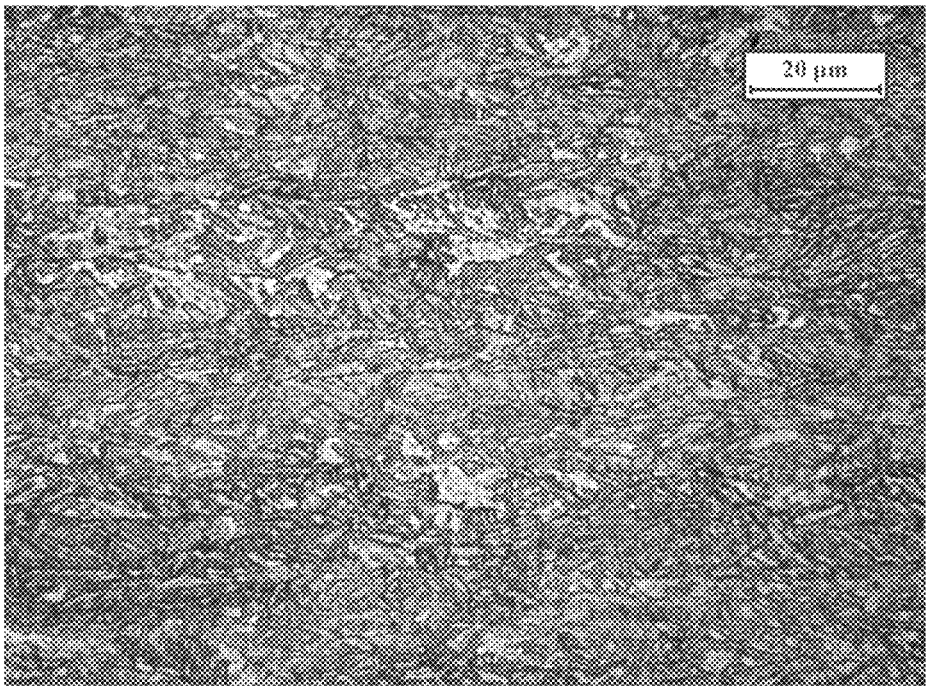
FIG. 1 is an image of the metallographical structure of the steel of Example 1 according to the disclosure.
Figure 2:
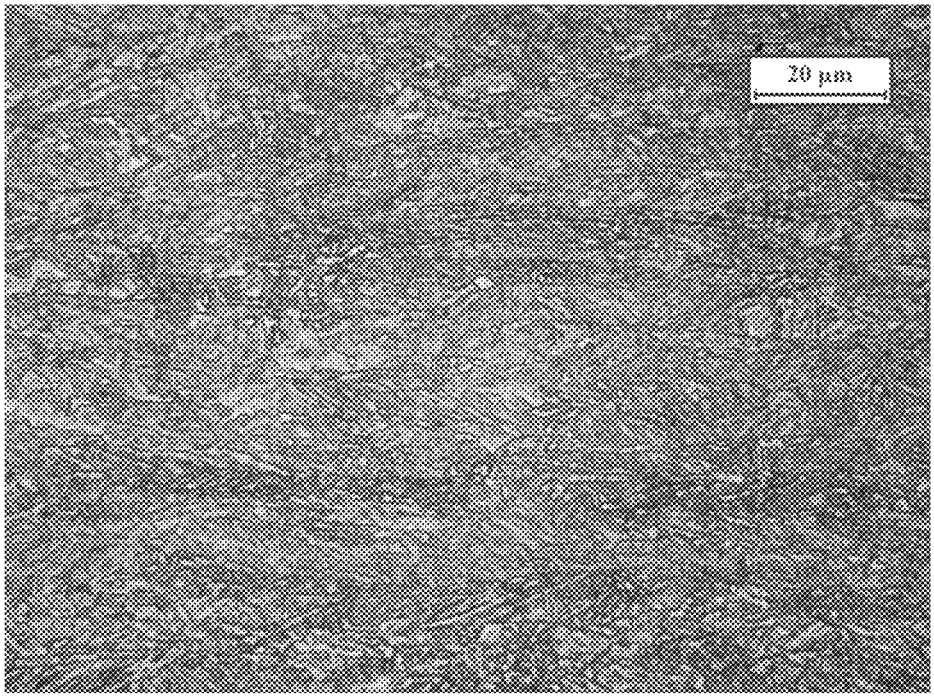
FIG. 2 is an image of the metallographical structure of the steel of Example 5 according to the disclosure.
Figure 3:
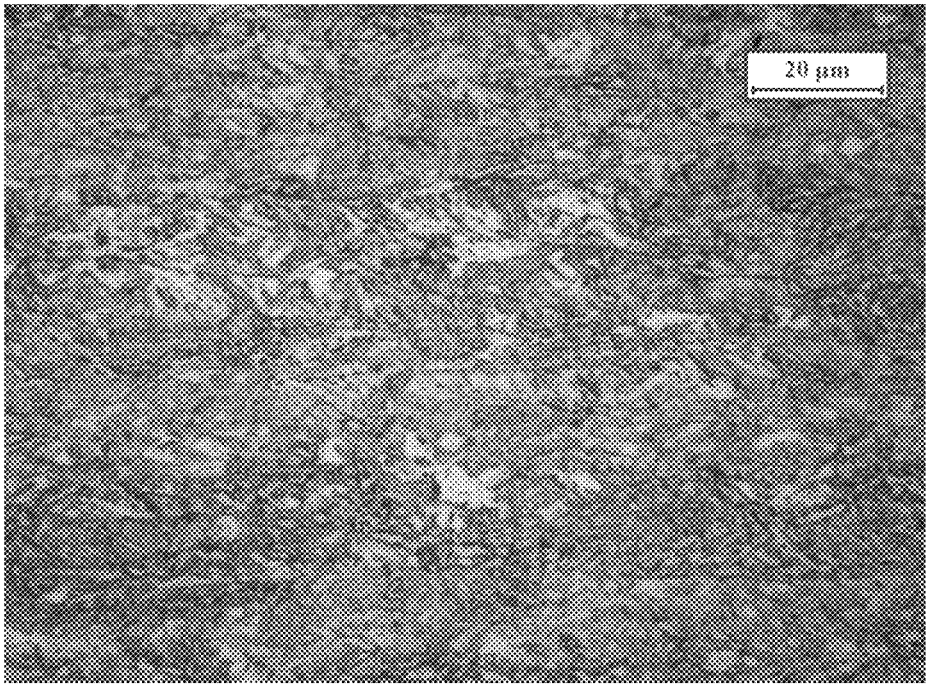
FIG. 3 is an image of the metallographical structure of the steel of Example 8 according to the disclosure.

FIGS. 1-3 show the metallographical structure images of the test steels of Examples 1, 5 and 8. As can be seen, the metallographical structures of the final steel plates are homogeneous lath-shaped tempered martensite, and the structures are fine.

TABLE 1

Chemical compositions of the Examples according to the disclosure
Unit: weight percentage

| No. | C | Si | Mn | Cr | Mo | V | Ni | Nb | Ti | B | Al | Ca | P | S | N | O |
|---|---|---|---|---|---|---|---|---|---|---|---|---|---|---|---|---|
| Composition 1 | 0.06 | 0.15 | 1.59 | 0.7 | 0.12 | 0.05 | 0 | 0.016 | 0.01 | 0.0026 | 0.06 | 0.004 | 0.015 | 0.0015 | 0.0025 | 0.0056 |
| Composition 2 | 0.14 | 0.12 | 0.82 | 0.41 | 0.28 | 0.012 | 0.3 | 0.008 | 0.03 | 0.001 | 0.034 | 0.004 | 0.01 | 0.0014 | 0.0044 | 0.0034 |
| Composition 3 | 0.065 | 0.2 | 1.03 | 0.54 | 0.17 | 0.039 | 0.25 | 0.03 | 0.012 | 0.003 | 0.023 | 0.0026 | 0.007 | 0.0021 | 0.0027 | 0.0073 |
| Composition 4 | 0.13 | 0.1 | 1.26 | 0.2 | 0.4 | 0.035 | 0.27 | 0.016 | 0.016 | 0.002 | 0.06 | 0.0025 | 0.013 | 0.0015 | 0.0038 | 0.0023 |
| Composition 5 | 0.07 | 0.3 | 1.24 | 0.6 | 0.34 | 0.047 | 0.29 | 0.01 | 0.018 | 0.0005 | 0.05 | 0.0013 | 0.013 | 0.0011 | 0.0047 | 0.0056 |

TABLE 2

Rolling process conditions of the Examples according to the disclosure

| Ex. | Chemical composition | Heating Temperature, ° C. | Holding time, min | Final rolling temperature, ° C. | On-line quenching cooling speed, ° C./s | Final cooling temperature, ° C. | Tempering heating temperature, ° C. | Tempering holding time, min |
|---|---|---|---|---|---|---|---|---|
| Ex. 1 | Composition 1 | 1210 | 130 | 889 | 56 | 134 | 400 | 180 |
| Ex. 2 | Composition 1 | 1210 | 190 | 835 | 31 | 176 | 520 | 60 |
| Ex. 3 | Composition 2 | 1270 | 120 | 865 | 54 | 85 | 500 | 55 |
| Ex. 4 | Composition 2 | 1220 | 210 | 870 | 75 | 234 | 550 | 28 |
| Ex. 5 | Composition 3 | 1250 | 120 | 883 | 72 | 253 | 490 | 50 |
| Ex. 6 | Composition 3 | 1150 | 100 | 829 | 63 | 120 | 520 | 20 |
| Ex. 7 | Composition 4 | 1200 | 160 | 892 | 67 | 90 | 420 | 130 |
| Ex. 8 | Composition 4 | 1190 | 120 | 828 | 54 | 119 | 500 | 65 |
| Ex. 9 | Composition 5 | 1170 | 180 | 823 | 52 | 230 | 410 | 100 |
| Ex. 10 | Composition 5 | 1240 | 150 | 827 | 82 | 60 | 550 | 45 |

TABLE 3

Mechanical properties of the Examples according to the disclosure

| Ex. | Yield strength MPa | Tensile strength MPa | Elongation % | Impact energy at −40° C. (7.5 * 10 * 55 mm) J | | |
|---|---|---|---|---|---|---|
| Ex. 1 | 917 | 958 | 12.8 | 46 | 52 | 58 |
| Ex. 2 | 842 | 873 | 14.2 | 90 | 97 | 101 |
| Ex. 3 | 888 | 909 | 13.8 | 53 | 58 | 63 |
| Ex. 4 | 851 | 878 | 14.7 | 86 | 69 | 81 |
| Ex. 5 | 862 | 904 | 14.2 | 93 | 79 | 82 |
| Ex. 6 | 839 | 882 | 14.5 | 87 | 91 | 85 |
| Ex. 7 | 894 | 929 | 13.6 | 46 | 54 | 49 |
| Ex. 8 | 871 | 898 | 15.1 | 73 | 73 | 53 |
| Ex. 9 | 902 | 933 | 13.1 | 89 | 76 | 83 |
| Ex. 10 | 875 | 891 | 15.3 | 102 | 98 | 92 |

The invention claimed is:

1. A high-strength steel consisting of the following components by weight percentage: C: 0.06-0.14%, Si: 0.10-0.30%, Mn: 1.03-1.26%, Cr: 0.20-0.70%, Mo: 0.10-0.40%, Ni: O<Ni≤0.30%, Nb: 0.010-0.030%, Ti: 0.010-0.030%, V: 0.010-0.050%, B: 0.0005-0.0030%, Al: 0.02-0.06%, Ca: 0.001-0.004%, N: 0.002-0.005%, P≤0.020%, S≤0.010%, O≤0.008%, and the balance of Fe and unavoidable impurities; wherein the above elements meet the following relationships: 0.40%<Ceq<0.50%, Ceq=C+Mn/6+(Cr+Mo+V)/5+(Ni+Cu)/15, 0.7%≤Mo+0.8Ni+0.4Cr+6C≤1.1%; 3.7≤Ti/N≤7.0; and 1.0≤Ca/S≤3.0; and wherein the high-strength steel has a yield strength of 800-917 MPa, a tensile strength of 850-958 MPa, an elongation >12%, and an impact energy at −40° C.>40J, wherein a microstructure of the high-strength steel consists of uniform lath-shaped tempered martensite, and wherein the high-strength steel is structured for engineering machinery, crane jibs, or dumper bodies.

2. A method of manufacturing the high-strength steel of claim 1, comprising the following steps:

1) smelting the components recited in claim 1 in a converter or electrical furnace, refining, and casting to a cast blank;

2) heating the cast blank in a furnace at 1150-1270° C., wherein, when the temperature of the core of the cast blank reaches the furnace temperature, the temperature is held, and the holding time is >1.5h;

3) rolling the cast blank to a target thickness by single-stand reciprocating rolling or multi-stand hot continuous rolling, wherein a final rolling temperature is 820-920° C., and the final rolling temperature Tf meets: $Ar_3$<Tf<Tnr, wherein $Ar_3$ is a temperature at which hypo-eutectoid steel austenite begins to convert to ferrite: $Ar_3$=901-325C-92Mn-126Cr-67Ni-149Mo; Tnr is non-recrystallization critical temperature: Tnr=887+464C+(6445Nb−644sqrt(Nb))+(732V230sqrt(V))+890Ti+363Al-357Si; a rolling reduction rate at a final rolling path is >15%;

4) conducting on-line quenching to (Ms-150) ° C. or lower after the rolling by using a laminar cooling system to control a cooling speed of $V>e^{(5.3-2.53c-0.16Si-0.82Mn-0.95Cr-1.87Mo-160B)}$° C./s, so as to guarantee formation of full martensitic structure, wherein Ms is a temperature at which transformation of martensite begins, Ms=539-423C-30.4Mn-17.7Ni-12.1Cr-11.0Si-7.0Mo; and 5) subjecting to tempering heat treatment at a tempering temperature of 400-550° C.; wherein when the temperature of the core of the steel plate arrives at the furnace temperature, the temperature is held, and the holding time is 20-180 min thereby producing the high-strength steel of claim 1.

* * * * *